US005653081A

United States Patent [19]

Wenrick et al.

[11] Patent Number: 5,653,081

[45] Date of Patent: Aug. 5, 1997

[54] METHOD FOR PAYING OUT AN INSULATION SUPPORT SHEET FOR USE WITH AN INSULATED ROOF STRUCTURE

[75] Inventors: Dennis K. Wenrick, Oviedo, Fla.; Robert J. Alderman, Canyon Lake, Tex.; James E. Taylor, Seguin, Tex.; Ernest J. Plant, Seguin, Tex.

[73] Assignee: Owens-Corning Fiberglas Technology, Inc., Summit, Ill.

[21] Appl. No.: 645,995

[22] Filed: May 14, 1996

[51] Int. Cl.[6] ..... E04D 5/00

[52] U.S. Cl. ..... 52/742.12; 52/746.11; 52/407.5; 52/749.12

[58] Field of Search ..... 52/742.12, 746.1, 52/746.11, 407.2, 407.4, 404.3, 404.5, 745.06, 409, 408, 478

[56] References Cited

U.S. PATENT DOCUMENTS

| | | | |
|---|---|---|---|
| 3,559,914 | 2/1971 | Alderman . | |
| 3,969,863 | 7/1976 | Alderman . | |
| 4,047,345 | 9/1977 | Alderman . | |
| 4,047,346 | 9/1977 | Alderman . | |
| 4,068,446 | 1/1978 | Brueske . | |
| 4,075,807 | 2/1978 | Alderman . | |
| 4,147,003 | 4/1979 | Alderman . | |
| 4,222,212 | 9/1980 | Alderman . | |
| 4,263,763 | 4/1981 | Bouwens . | |
| 4,379,381 | 4/1983 | Holcombe | 52/404.3 |
| 4,434,601 | 3/1984 | Zellmer . | |
| 4,446,664 | 5/1984 | Harkins . | |
| 4,967,535 | 11/1990 | Alderman . | |
| 5,495,698 | 3/1996 | Alderman et al. | 52/746.11 X |
| 5,551,203 | 9/1996 | Alderman et al. | 52/746.11 |
| 5,561,959 | 10/1996 | Alderman et al. | 52/404.3 X |

*Primary Examiner*—Carl D. Friedman
*Assistant Examiner*—Aimee E. McTigue
*Attorney, Agent, or Firm*—C. Michael Gegenheimer; Curtis B. Brueske

[57] ABSTRACT

A method for providing a roof structure having a plurality of purlins spaced apart from one another in a parallel arrangement the purlins having top portions is disclosed. A carriage is providing upon which is mounted a roll of support sheet. A first section of the roof structure comprising purlins, a support sheet, insulation material, and hard roofing material is completed. An insulation support sheet having side edges which enable the support sheet to be laid on adjacent purlins is then provided. The side edges are aligned with the top portions of adjacent purlins so that the support sheet can depend from the adjacent purlins. The carriage is moved along the length of the purlins and away from the first section of the roof structure, in which the movement of the carriage pays out the support sheet in a pleated condition having a first width so that the edges of the support sheet are aligned with the top portions of adjacent purlins and the support sheet depends from adjacent purlins. The support sheet is unfolded between the purlins to a second width wider than the first width.

20 Claims, 5 Drawing Sheets

FIG. 4
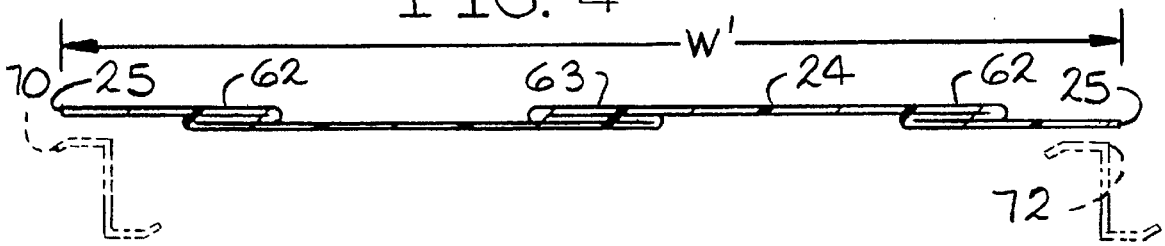
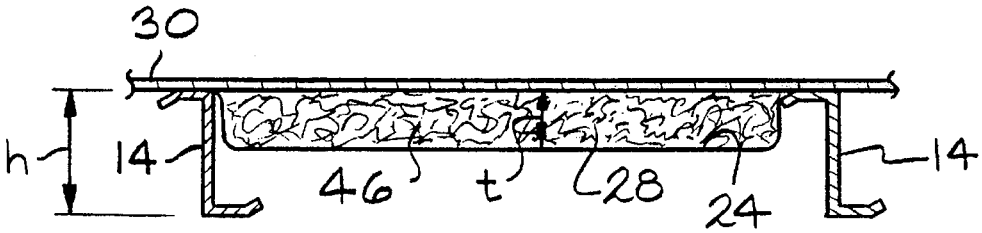
FIG. 5

METHOD FOR PAYING OUT AN INSULATION SUPPORT SHEET FOR USE WITH AN INSULATED ROOF STRUCTURE

TECHNICAL FIELD

This invention relates to the construction of an insulated metal roof structure for use in commercial and industrial buildings.

BACKGROUND ART

Metal roof structures typically comprise a series of parallel rafter beams extending across the building in one direction and purlin beams parallel to each other mounted on top of the rafters extending in a direction normal to the rafters. Insulation material in long sheets is placed in the area between purlins. The sheets of insulation material can be laid along the length of the purlins or across the purlins in a direction normal to the purlins. If desired, the roof structure can have a first layer of insulation material which is laid along the length of the purlins, and a second layer of insulation material which is laid laterally across the purlins on top of the first layer on insulation. Hard roofing material such as metal decking is then attached on top of the purlins over the insulation material. Because the hard roofing material comes in long sheets and the roofs generally have two sloped sections, it is customary to construct the roof along the length of the structure from one end to the other. The workers stand on the previously laid section of roof to construct the next section.

The insulation material must be supported between the purlins beneath the hard roofing material. Various methods of supporting the insulation material have been used. Mounting straps or wire mesh which are attached to or draped over the purlins forming a lattice have been used. This is referred to as banding. A sheet, typically made of vinyl and acting as a vapor barrier, is then rolled onto the lattice, and insulation material is placed between adjacent purlins and over the sheet. If the installation of the lattice is done from underneath the roof structure, scaffolding or lifting equipment is typically required for installation. Since the lattice encompasses the entire roof, installation is costly and time consuming. Once the hard roofing material is mounted on the purlins, the sheet can support the insulation material and the lattice no longer serves any useful purpose.

Some systems dispense with the lattice and use the sheet itself to support the insulation material. The support sheet is draped from the adjacent purlins and the insulation material is placed on top of the support sheet. A carriage has been used to aid in the dispensing of the support sheet. The carriage is positioned on top of the purlins and travels the length of the purlins during the roof construction. A roll of the support sheet material is mounted on the carriage and the support sheet is dispensed from the roll and placed on top of the purlins. As the carriage travels the length of the purlins, the support sheet is draped across the purlins. However, the support sheet sags between the purlins and results in a small vertical height at the sides of the insulation cavity adjacent to the purlins, and results in a compression of the insulation material in that area.

An additional step to compensate for the small vertical height when draping the insulation material is to use clips to hold the support sheet onto the purlin to reduce sagging. Clips that are attached to the bottom of the purlins require installation from underneath the roof structure and typically require scaffolding or lifting equipment. Clips that are installed over the purlins and extend the support sheet downward are known in the art but require the workers to lean over the edge of the previously laid section of roof and attach the clip to the purlin. Because of the increased costs due to the expense of the installation and the clips themselves, the use of clips is undesirable.

Guides have been used to prevent the sagging of the support sheet and increase the vertical height at the sides of the insulation cavity adjacent to the purlins. The guides are mounted on the carriage and extend downward on top of the sheet. The guides are positioned near the purlins so that the sides of the sheet extend downward. This causes the sheet to create a generally rectangular cross-sectional area into which the insulation material can be placed. The guides, however, can tear up the sheet as the carriage moves along the length of the purlins. Also, because the guides must force the sheet downward, the longitudinal edges of the sheet can be misaligned with the tops of the purlins. The edges of the sheet must then be re-aligned so that when the hard roofing material is attached to the tops of the purlins, the sheet supports the insulation. This misalignment also exposes the edges of the sheet, thereby creating an undesirable appearance when the roof structure is viewed from below.

It would be desirable to have a system of building a roof structure which is inexpensive and simple to construct and which does not require the use of lattice straps, clips, or guides, yet provides for an insulation support system which enables the full thickness of the insulation blanket to be used.

DISCLOSURE OF THE INVENTION

There has now been invented an improved method for providing a roof structure in which a pleated support sheet for supporting insulation material is dispensed between purlin roof beams. The method provides for an inexpensive and simple system with which to construct a roof structure capable of using the full thickness of the insulation blanket.

The present invention provides for a roof structure having a plurality of purlins spaced apart from one another in a parallel arrangement. The purlins have a generally vertical portion. The space between the vertical portions of adjacent purlins defines an insulation cavity which is generally rectangular in cross-sectional shape. The improved method includes providing a carriage upon which is mounted a roll of support sheet. A first section of the roof structure is then completed, with the roof structure comprising purlins, a support sheet, insulation material, and hard roofing material. The carriage is moved along the length of the purlins and away from the first section of the roof structure, where moving the carriage pays out the support sheet in a longitudinally pleated condition so that the support sheet depends from adjacent purlins. The support sheet is unfolded to substantially conform to the insulation cavity. A first layer of insulation material can then be applied on top of the support sheet. Typically, the insulation material is dispensed from a roll and is applied in a direction parallel to the purlins. Applying the first layer of insulation material on top of the support sheet assists in unfolding the support sheet to substantially conform to the insulation cavity. If desired, a second layer of insulation material can be applied on top of the first layer of insulation material, such that the second layer of insulation material is dispensed from a roll and laid laterally across the purlins.

In a specific embodiment of the invention, the support sheet has longitudinal pleats which are positioned adjacent to the longitudinal edges of the support sheet. The longitudinal pleats unfold to form side portions inside the insulation cavity. In another specific embodiment of the invention, the support sheet has a longitudinal pleat which is positioned generally in the center of the support sheet.

In another specific embodiment of the invention, the support sheet is wound on a roll in a pleated condition and is then payed out from the carriage. The support sheet can also be wound on a roll in a flat orientation and then pleated by a folding shoe mounted on the carriage as the support sheet is being payed out from the roll.

BRIEF DESCRIPTION OF THE DRAWINGS

FIG. 4 is a sectional view of the pleated support sheet taken along line 4—4 of FIG. 3.

FIG. 5 is a sectional schematic view of a roof structure made according to the invention, where the thickness of the insulation is less than the height of the purlin.

DETAILED DESCRIPTION

Figure 1:
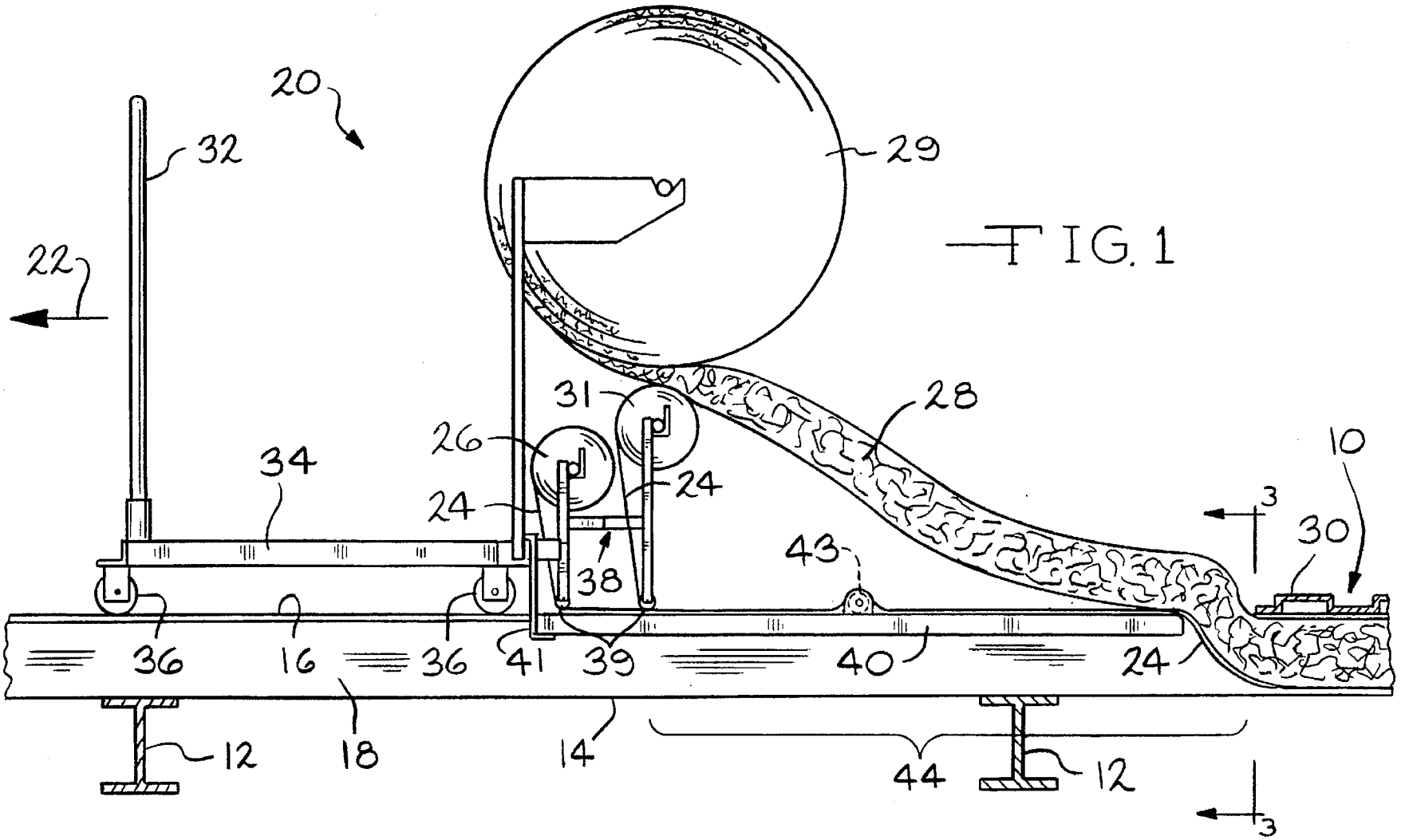
FIG. 1 is a schematic side elevational view of a carriage for providing a roof structure according to the present invention.
Figure 2:
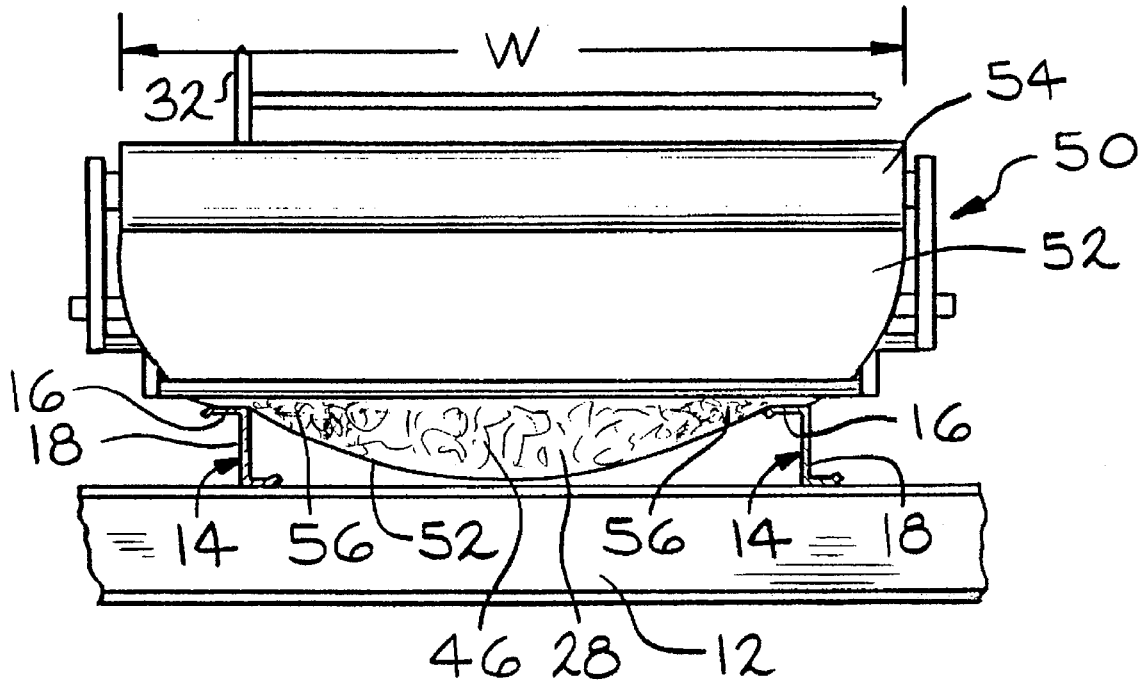
FIG. 2 (PRIOR ART)
FIG. 2 is a schematic elevational end view of a prior art carriage which is paying out a support sheet in a flat orientation from a roll.
Figure 3:
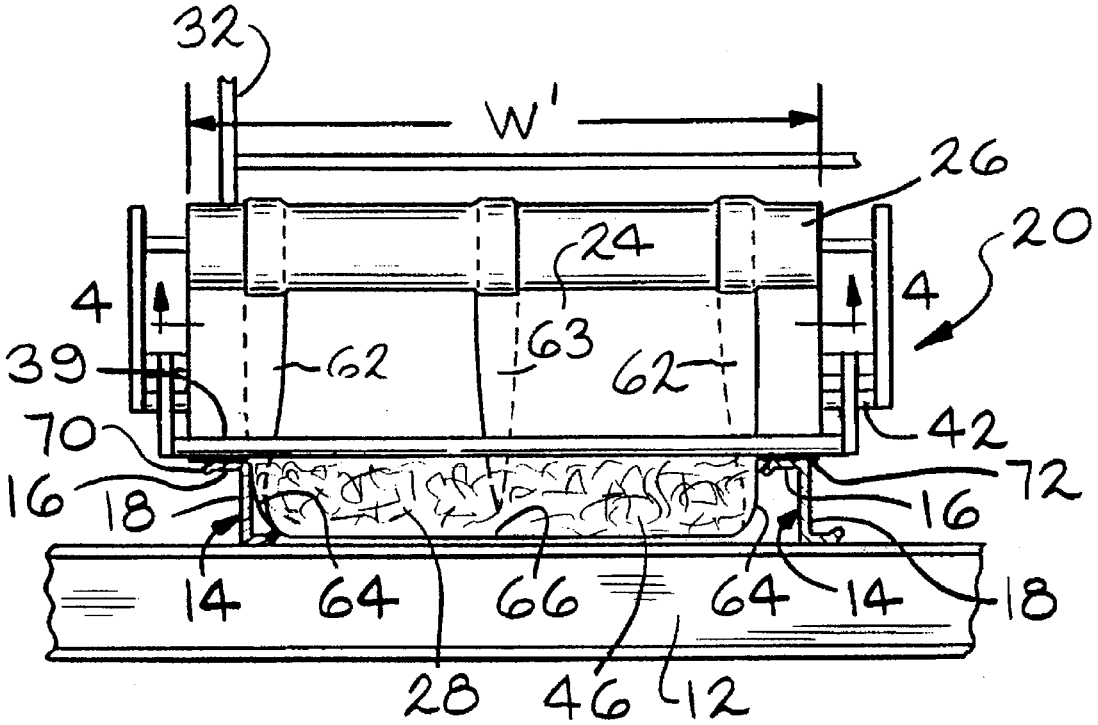
FIG. 3 is a schematic elevational end view of the carriage of FIG. 1, taken along line 3—3 of FIG. 1, with the insulation material and the plate removed for clarity.

There is illustrated in FIG. 1 a building roof structure, indicated generally at 10. The roof structure is supported by main rafter beams 12 which are positioned parallel to each other. A plurality of purlins 14, spaced apart and arranged parallel to each other, are fastened on top of the rafters in a direction normal to the rafters. The spacing of the purlins is typically 5 feet (1.82 m) on centers. As shown in FIGS. 2 and 3, the purlins have a generally Z-shaped cross-section and include a top portion 16 and a vertical portion 18. Roof structures may also be constructed from bar joists or trusses, and the invention as described herein will work equally well with purlins, bar joists or tresses. The use of the term "purlins" in this specification and claims includes not only traditional purlins, but also joists, tresses, and other similar structural members.

Broadly stated, the roof structure is constructed by use of a carriage 20 which rides on the top portion of the purlins and travels along the length of the purlins in a downstream direction, represented by an arrow 22. As the carriage is moved, a support sheet 24 having longitudinal edges 25 (FIG. 4) is payed out from a roll 26. The support sheet is draped on top of adjacent purlins so that the support sheet depends from the top portion of the purlins. The support sheet 24 of the present invention is pleated as shown in FIG. 4, the reason for which will be explained in detail below. The support sheet supports a layer of insulation material 28 which is placed on top of the support sheet between the adjacent purlins. The insulation material is typically dispensed from a roll 29 but can be applied by any suitable manner, such as by applying insulation batts on top of the support sheet. After the insulation material has been placed on the support sheet, long sheets of hard roofing material 30, such as metal roof decking, are then attached to the top portion of the purlins over the support sheet and insulation. The hard roofing material can be fastened to the purlins in any suitable manner, such as by threaded fasteners or clips. The attachment of the hard roofing material presses down on the edges 25 of the support sheet which are sandwiched between the top portions 16 of the purlins and the hard roofing material 30, so that the support sheet supports the insulation between the purlins.

Because the hard roofing material comes in long sheets, typically 30 to 35 feet (10.9 to 12.8 m), and the roofs generally have two sloped sections, it is customary to construct a first section of the roof structure along the width of the sloped section and then proceed along the length of the structure from one end to the other. The workers stand on the previously attached first section of the roof structure to assemble the next section of roof. The carriage travels along the length of the purlins and is moved by the workers as each new section of roof is assembled.

Although the accompanying Figures show a carriage extending between only two adjacent purlins, the carriage can be any length up to the width of the roof itself. Preferably, the carriage is comprised of a plurality of carriage sections which can be joined together so that they span the entire width of the sloped section of the roof. The carriage is then propelled across the purlins by pulling means, such as a winch (not shown), in the downstream direction 22 so that all the carriage sections move in unison. Because the support sheet is draped across the top portion of adjacent purlins, the total width of the support sheet is wider than the distance between the purlins. Therefore, adjacent support sheet rolls are not co-linear and must be slightly staggered. Typically, a carriage section covers two purlin spans, i.e., about 10 feet (3.7 m) in length. Preferably, each carriage section has both a leading roll 26 and a trailing roll 31 of insulation support sheet, one roll for each of two adjacent purlin spans. The edge of the support sheet from the trailing roll 31 will be draped on top of the edge 25 of the support sheet from the leading roll 26 as the carriage moves in the downstream direction. Multiple identical carriage sections, each having a leading and trailing roll, can therefore be joined together, with every roll being staggered from an adjacent roll.

The carriage can be any suitable apparatus which moves along the top of the purlins and dispenses the support sheet. As seen from FIG. 1, the carriage 20 includes safety handrails 32 and a deck 34 for the worker to stand on while operating or moving the carriage. Preferably, the carriage has hourglass-shaped rollers 36 riding on the top portion 16 of the purlins 14 for ease of movement. The carriage also includes a framework 38 for mounting the rolls 26 and 31. Although two support sheet rolls are shown in FIG. 1, one is the leading roll 26 shown in the foreground, and the other is the trailing roll 31 shown in the background. Mounted on the framework are mining bars 39 which extend laterally across the support sheet and are positioned slightly above the top portions 16 of the purlins 14 so as to direct the support sheet to a generally horizontal position.

Attached to the carriage is a plate 40 which extends from the carriage 20 in an upstream direction opposite the downstream direction 22. The plate supports the portion of the payed support sheet and the insulation material which has not yet been supported by the fastening of the hard roofing material 30. The plate also provides for wind resistance, and if sufficiently built, the plate can be used for fall protection for the workers to prevent them from falling off the leading edge of the previously completed section of roof. The plate can be attached to the carriage by any suitable means, but preferably is attached to the carriage by a hook 41 which vertically extends from the plate. The plate follows the carriage as the carriage moves along the length of the purlins. Preferably, the plate has rollers 43 which ride along the top portion 16 of the purlins 14. However, it is not required that the payed out support sheet be supported by the plate. The carriage could be modified so that the support sheet is payed out so that the support sheet is underneath the plate. The plate is generally located in a gap 44 which exists between the completed section of the roof structure 10 and the carriage 20. The plate hinders wind from blowing vertically through the gap 44 and thus, disturbing the insulation material 28 and the support sheet 24. Although the insulation material is shown dispensed from a roll 29 mounted on the carriage, the insulation roll can also be laid directly on the plate.

The space between the vertical portions 18 of adjacent purlins 14 defines an insulation cavity 46, as seen from FIG. 3. The insulation cavity 46 has a generally rectangular cross-sectional shape. It is advantageous to fill out the insulation cavity uniformly with the insulation material without leaving relatively large gaps, thereby maximizing the insulating qualities of the roof structure. The purpose of the support sheet is to support the insulation material in the insulation cavity, but the support sheet can also be used as a vapor barrier, and for aesthetic purposes. The support sheet can be of any suitable material for the stated purposes, such as vinyl or foil faced paper.

FIG. 2 illustrates a prior art carriage 50 which pays out a support sheet 52 from a roll 54 mounted on the carriage 50. Since the support sheet 52 is draped across adjacent purlins and hangs down into the insulation cavity 44, the support sheet must be wider than the distance between the purlins. For example, purlins that are spaced apart 5 feet (1.82 m) on centers have about a 57 inch (145 cm) space between adjacent purlins. The support sheet for this type of purlin spacing has a width W which is about 72 inches (183 cm). When the prior art support sheet 52 is payed out across the purlins, the support sheet naturally sags resulting in a small vertical height at the sides 56 of the insulation cavity adjacent the purlins. This results in a compression of the insulation material at the sides 56. The insulation material does not substantially conform to the generally rectangular insulation cavity. Because of the compressed sides, the insulation material does not uniformly fill the generally rectangular insulation cavity. Although guides (not shown) which extend downwardly on top of the support sheet and into the insulation cavity have been used to compensate for this sagging shape, the guides can tear the support sheet. Also, the longitudinal edges of the support sheet are not easily aligned with the top portion 16 of the purlins 14, and misalignment can occur.

FIG. 3 illustrates the carriage 20 paying out the support sheet 24 from the roll 26 in which the support sheet has a pair of pleats 62 positioned adjacent the longitudinal edges of the support sheet, and a central pleat 63 positioned generally in the center of the support sheet. For clarity, the plate 40 and the roll of insulation material 29 are not shown. The support sheet is wound on the roll 26 in a pleated condition. The pleats are areas in which the support sheet 24 is partially folded over on itself, as best seen in the cross-section of FIG. 4. As the pleated support sheet unrolls from the roll 26 and is payed out into the insulation cavity, the pleats unfold, thereby expanding the width of the support sheet. It has been found that longitudinal pleated support sheets enable the support sheet, and consequently, the insulation material itself, to more uniformly fill the insulation cavity so that the insulation material substantially conforms to the generally rectangular insulation cavity.

Figure 6:
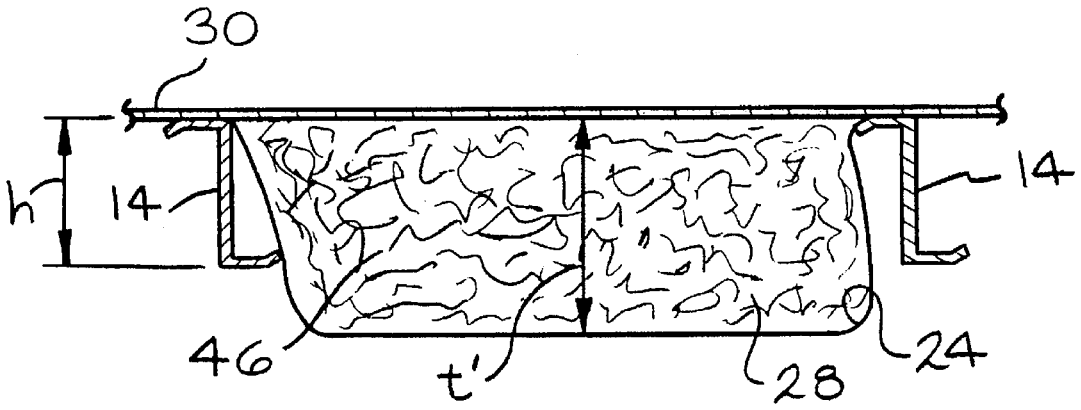
FIG. 6 is a sectional schematic view of a roof structure made according to the invention, where the thickness of the insulation is greater than the height of the purlin.
Figure 7:
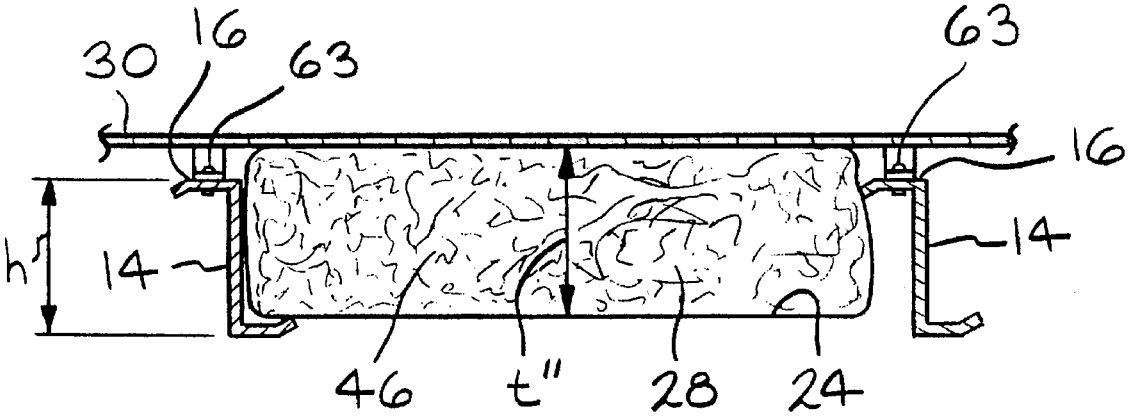
FIG. 7 is a sectional schematic view of a roof structure made according to the invention, where the hard roofing material is mounted on clips.

As shown in FIGS. 5 through 7, the insulation cavity 46 can have different heights depending on the thickness of the insulation material used and the location of the hard roofing material. Although the height of the insulation cavity is different from the height of the purlins, in the examples shown in FIGS. 5 through 7, the insulation material 28 still substantially conforms to the generally rectangular insulation cavity. For example, as shown in FIG. 5, the thickness t of the insulation material 28 is smaller than the height h of the purlin 14. FIG. 6 illustrates a situation in which the thickness t' of the insulation material is larger than the height h of the purlins. FIG. 7 illustrates a roof structure which utilizes clips 63 to fasten the hard roofing material 30 to the top portion 16 of the purlins 14. The clips position the hard roofing material above the top portion of the purlins. The thickness t" of the insulation material extends from the bottom of the purlins to the hard roofing material. The height of the insulation cavity is, therefore, the distance between the hard roofing material and the generally horizontal portion of the support sheet.

The support sheet is preferably in longitudinal tension, but not in lateral tension. The longitudinal tension can be created by fastening a tensioning device (not shown) to the roll so that the roll will not freely unwind. Preferably, the tensioning device will permit unwinding of the roll with a small pulling force, but will prevent the roll from unwinding itself due to the weight of the support sheet or by the force of the wind acting on the support sheet. The longitudinal tension is desirable because a taut support sheet provides for a smooth neat appearance when the roof is viewed from below. Also, the longitudinal tension provides for accurate alignment of the edges 25 of the support sheet with the top portion 16 of the purlins 14. Since the support sheet is generally not in lateral tension, the plate 40 is provided to support the support sheet so that the support sheet does not unfold by its own weight thereby pulling the edges of the support sheet off of the top portion of the purlins. After leaving the upstream end of the plate, the support sheet unfolds to expand its width to substantially conform to the shape of the insulation cavity, as seen in FIG. 3. The weight of the insulation material placed on top of the support sheet assists in expanding the width of the support sheet. For example, the support sheet can unfold and expand to create vertical portions 64 adjacent the purlins and a horizontal portion 66, thereby substantially conforming to the shape of the generally rectangular insulation cavity 46. The unfolding of the support sheet is assisted by the weight of the insulation material.

The pleated support sheet also provides for ease of alignment of the edges of the support sheet with the top portion 16 of the purlins 14. As shown in FIGS. 3 and 4, the roll 26 has a first width W' which is smaller than the width W of the roll 54 of FIG. 2, even though a second total unfolded width of the support sheets 24 and 52 are the same. For example, for a purlin spacing of about 60 inches (152 cm) requiring a support sheet having a total width of about 72 inches (183 cm), a pleated roll having a width of about 64 inches (163 cm) is increased by about 12.5 percent when the support sheet is unfolded. Preferably, the width of the pleated support sheet when wound on the roll is increased by at least 3 percent when the support sheet is unfolded so that the support sheet substantially conforms to the shape of the generally rectangular insulation cavity.

The width W of the roll 26 is preferably slightly larger or the same width as the distance from far opposing edges 70 and 72 of the top portions 16 of adjacent purlins 14. Therefore, when the support sheet 24 is payed out from the roll 26, the longitudinal or side edges of the support sheet are aligned with the purlins so that the longitudinal edges of the support sheet cover the top portions of the purlins. This assures that when the hard roofing material 30 is attached to the top portion of the purlins, the support sheet is underneath and is being supported along its longitudinal edges.

Although the support sheet 24, as shown in FIGS. 3 and 4, has three longitudinal pleats 62, 63, 62, the support sheet can have any number of pleats, or can have a single pleat. Likewise, the pleats can have any suitable width which results in a reduction of the original width of the support sheet to the width W.

Figure 8:
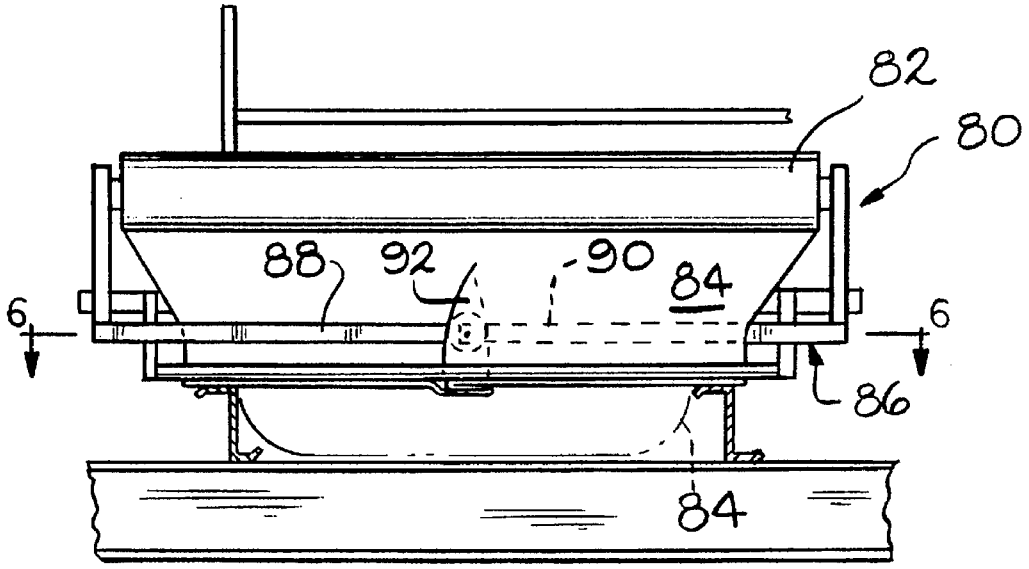
FIG. 8 is a schematic end view of an alternate embodiment of the invention showing the support sheet being payed out in a flat orientation from a roll and then pleated by a folding shoe fastened to the carriage.
Figure 9:
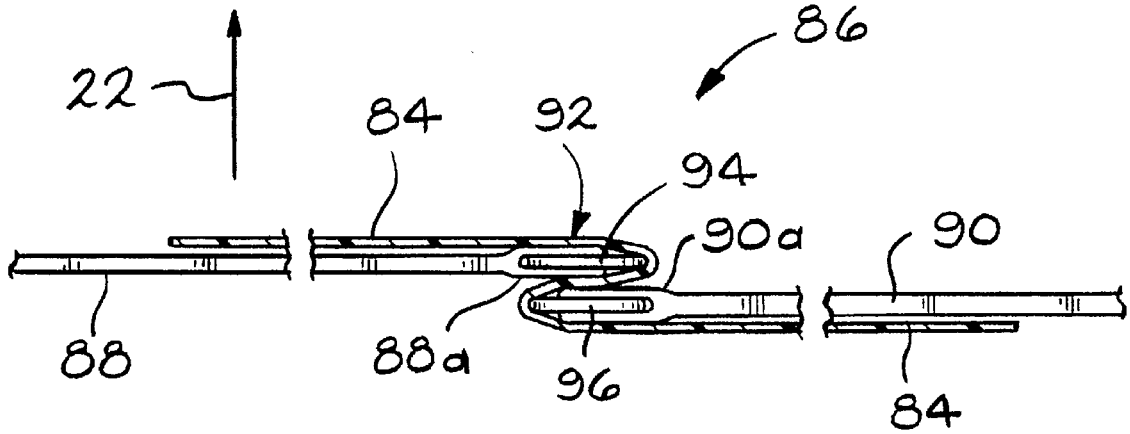
FIG. 9 is a sectional view taken along line 6—6 of FIG. 8.

Although the support sheet 24 is described above as being wound on the roll 26 in a pleated condition, the support sheet can be dispensed from the roll in a flat orientation, pleated by a pleating apparatus mounted on the carriage such that the pleated support sheet has the width W', and then payed out into the insulation cavity to unfold under the weight of the insulation material. FIG. 8 is a schematic end view of an alternate embodiment of a carriage, indicated generally at 80, upon which is mounted a roll 82 of support sheet 84. The support sheet is wound on the roll in a flat orientation, i.e., having no pleats. Mounted on the carriage 80 is a folding shoe 86 having two arms 88 and 90 which extend in a lateral direction with respect to the support sheet. As shown in FIG. 9 where the sectional view of the support sheet is taken, the arm 88 is positioned on the upstream side of the generally vertical support sheet, while the arm 90 is positioned on the downstream side of the generally vertical support sheet. Preferably, the arms are made of a material having a low coefficient of friction. The arms 88 and 90 have end portions 88*a* and 90*a*, respectively, which overlap each other. The overlapping causes the support sheet to form a pleat 92 as the support sheet is fed through the folding shoe, such that the pleated support sheet has the width W'. Preferably, rotatably mounted on the end portions 88*a* and 90*a* are rollers 94 and 96, respectively. The rollers provide for a rolling contact at the edges of the pleat 92 to help prevent tearing as the support sheet is fed through the folding shoe. Since the distance of the overlapping determines the width of the pleat 92, the arms can be adjustably mounted to provide for ease in adjusting the width of the pleat to any desired size. Of course, the folding shoe can be equipped with any number of arms to create numerous pleats. Although a folding shoe having extending arms is shown, the carriage 80 can be equipped with any suitable pleating apparatus, such as a contoured channel, not shown.

It will be evident from the foregoing that various modifications can be made to this invention. Such, however, are considered as being within the scope of the invention.

INDUSTRIAL APPLICABILITY

The invention can be useful in the construction of roof structures for commercial buildings.

We claim:

1. A method for providing a roof structure having a plurality of purlins spaced apart from one another in a parallel arrangement, the purlins having top portions, the method comprising:

a. providing a carriage upon which is mounted a roll of an insulation support sheet, where the insulation support sheet has side edges which enable the support sheet to be laid on adjacent purlins, with the side edges generally aligned with the top portions of adjacent purlins so that the support sheet can depend from the adjacent purlins;

b. moving the carriage along the length of the purlins where moving the carriage pays out the support sheet in a pleated condition having a first width so that the edges of the support sheet are generally aligned with the top portions of adjacent purlins and the support sheet depends from adjacent purlins; and c. unfolding the support sheet between the purlins to a second width wider than the first width.

2. The method of claim 1 further comprising applying insulation material on top of the support sheet, where unfolding of the support sheet is assisted by the weight of the insulation material.

3.. The method of claim 2 in which the insulation material is dispensed from a roll and applied in a direction parallel to the purlins.

4. The method of claim 2 in which the insulation material is dispensed from a roll and applied in a direction lateral to the purlins.

5. The method of claim 1 in which the support sheet has longitudinal pleats positioned adjacent the longitudinal edges of the support sheet which unfold as the support sheet unfolds from the first width to the second width.

6. The method of claim 1 in which the support sheet has a longitudinal pleat positioned generally in the center of the support sheet which unfolds as the support sheet unfolds from the first width to the second width.

7. The method of claim 1 in which the support sheet is wound on the roll in a pleated condition having the first width.

8. The method of claim 1 in which the second width of the support sheet is at least 3 percent larger than the first width.

9. The method of claim 1 in which the support sheet is pleated by a folding shoe as the support sheet is being payed out from the carriage.

10. A method for providing a roof structure having a plurality of purlins spaced apart from one another in a parallel arrangement the purlins having top portions, the method comprising:

a. providing a carriage upon which is mounted a roll of an insulation support sheet, where the insulation support sheet has side edges which enable the support sheet to be laid on adjacent purlins, with the side edges generally aligned with the top portions of adjacent purlins so that the support sheet can depend from the adjacent purlins;

b. moving the carriage along the length of the purlins where moving the carriage pays out the support sheet in a pleated condition having a first width so that the edges of the support sheet are generally aligned with the top portions of adjacent purlins and the support sheet depends from adjacent purlins;

c. unfolding the support sheet between the purlins to a second width wider than the first width; and d. applying insulation material on top of the support sheet, where unfolding of the support sheet is assisted by the weight of the insulation material.

11. The method of claim 10 in which the insulation material is dispensed from a roll and applied in a direction parallel to the purlins.

12. The method of claim 10 in which the second width of the support sheet is at least 3 percent larger than the first width.

13. A method for providing a roof structure having a plurality of purlins spaced apart from one another in a parallel arrangement, the purlins having a generally vertical portion, the space between the vertical portions of adjacent purlins defining an insulation cavity which is generally rectangular in shape, the method comprising:

a. providing a carriage upon which is mounted a roll of support sheet;

b. moving the carriage along the length of the purlins where moving the carriage pays out the support sheet in a pleated condition so that the support sheet depends from adjacent purlins;

c. unfolding the support sheet in the insulation cavity; and d. applying insulation material on top of the support sheet so that the insulation material substantially conforms to the generally rectangular insulation cavity.

14. The method of claim 13 in which the insulation material is dispensed from a roll and applied in a direction parallel to the purlins.

15. The method of claim 13 in which the insulation material is dispensed from a roll and applied in a direction lateral to the purlins.

16. The method of claim 13 in which the support sheet has longitudinal pleats positioned adjacent the longitudinal edges of the support sheet which unfold as the support sheet unfolds in the insulation cavity.

17. The method of claim 13 in which the support sheet has a longitudinal pleat positioned generally in the center of the support sheet which unfolds as the support sheet unfolds in the insulation cavity.

18. The method of claim 13 in which the support sheet is wound on the roll in a pleated condition.

19. The method of claim 18 in which the unfolding of the support sheet increases the width of the support sheet by at least 3 percent over the width of the support sheet wound on the roll.

20. The method of claim 13 in which the support sheet is pleated by a folding shoe as the support sheet is being payed out from the carriage.

* * * * *